US007189062B2

(12) United States Patent
Fukizawa et al.

(10) Patent No.: US 7,189,062 B2
(45) Date of Patent: Mar. 13, 2007

(54) CENTRIFUGAL IMPELLER

(75) Inventors: Tai Fukizawa, Kawaguchi (JP); Issei Sato, Kawaguchi (JP)

(73) Assignee: Enplas Corporation, Saitama (JP)

( * ) Notice: Subject to any disclaimer, the term of this patent is extended or adjusted under 35 U.S.C. 154(b) by 198 days.

(21) Appl. No.: 10/994,284

(22) Filed: Nov. 23, 2004

(65) Prior Publication Data

US 2005/0111971 A1 May 26, 2005

(30) Foreign Application Priority Data

Nov. 26, 2003 (JP) ..... 2003-395326

(51) Int. Cl.
*F01D 5/22* (2006.01)

(52) U.S. Cl. ..... 416/185

(58) Field of Classification Search ..... 416/90 R, 416/91, 179, 185, 186 R
See application file for complete search history.

(56) References Cited

U.S. PATENT DOCUMENTS 4,257,744 A * 3/1981 Watson ..... 416/244 R
4,277,222 A * 7/1981 Barbeau ..... 415/177
4,647,271 A * 3/1987 Nagai et al. ..... 416/186 R
5,628,618 A * 5/1997 Imai et al. ..... 415/198.1
5,692,880 A * 12/1997 Zelder ..... 416/203
6,805,531 B2 * 10/2004 Iida et al. ..... 415/206

FOREIGN PATENT DOCUMENTS

JP 2-132820 11/1990

* cited by examiner

*Primary Examiner*—Edward K. Look
*Assistant Examiner*—Devin Hanan
(74) *Attorney, Agent, or Firm*—Staas & Halsey LLP

(57) ABSTRACT

A centrifugal impeller particularly for a turbo-charger includes a circular disc member, a boss portion formed at a central portion of the disc member and having a central through hole into which a rotational shaft is inserted, an impeller blade integrally formed on one surface side of the disc member, and a ring-shaped rib member arranged on the other surface side of the disc member so as to be coaxial with a center axis of the boss portion. A thickness reduced portion is formed to the disc member so as to have a thickness smaller than that of another portion of the disc member, and the thickness reduced portion is arranged adjacent to the rib member.

10 Claims, 4 Drawing Sheets

CENTRIFUGAL IMPELLER

BACKGROUND OF THE INVENTION

1. Field of the Invention

The present invention relates to an impeller, and more particularly, a centrifugal impeller utilized for a compressor of, for example, a turbo-charger.

2. Related Art

There is known a centrifugal impeller of the type mentioned above such as disclosed in Japanese Utility Model Laid-open Publication No. HEI 2-132820, for example. A turbo-charger disclosed in this publication is provided with a turbo-wheel driven by an energy of an exhaust gas from an engine of the turbo-charger, and the turbo-wheel is coupled with an impeller through a rotating (rotational) shaft so that the driving force of the turbo-wheel is transmitted to the impeller through the rotating shaft to rotate the impeller, and according to the rotation of the impeller, intake pressure on the intake (air-suction) side of the engine is increased and then supplied to the engine.

Such impeller is formed with a thickness reduced portion on a back side of a disc on which blades or vanes are formed so as to reduce a thickness between front and back surfaces of the disc and also formed with a boss or boss portion so as to protrude from such thickness reduced portion towards the back side of the disc, and a rib is formed so as to extend in the radial direction between the boss and the back surface of the disc.

According to the formation of such thickness reduced portion on the back surface side of the disc, a weight of the impeller is reduced and possibility of generation of defect at a time of resin molding process is reduced. Moreover, the formation of the rib extending in the radial direction between the boss and the back surface of the disc can preferably suppress deflection of the disc and displacement in the peripheral direction of the boss.

However, in such impeller structure as mentioned above, since a plurality of ribs are formed along the radial direction, when the impeller is rotated at a high speed, the ribs constitute resistance and, hence, generate aerodynamic load. In addition, since the ribs and the thickness reduced portion are alternately formed to portions around the boss portion, it is difficult to feed the resin uniformly to the peripheral edge portion of the impeller at an injection molding process using a mold.

SUMMARY OF THE INVENTION

An object of the present invention is to substantially eliminate defects or drawbacks encountered in the prior art mentioned above and hence to provide a centrifugal impeller having a compact and strong structure, capable of reducing an aerodynamic load and maintaining a well-balanced flow of the resin at a resin injection molding process.

This and other objects can be achieved according to the present invention by providing an impeller comprising:

a circular disc member;

a boss portion formed at a central portion of the disc member, the boss portion having a central through hole into which a rotational shaft is inserted;

an impeller blade integrally formed on one surface side of the disc member;

a rib member having a ring-shape and arranged on another surface side of the disc member so as to be coaxial with a center axis of the boss portion; and a thickness reduced portion formed to the disc member having a thickness smaller than that of another portion of the disc member, the thickness reduced portion being arranged adjacent to the rib member.

In a preferred embodiment of the present invention of the above aspect, it is desired that the thickness reduced portion is formed at least one of portions between the rib member and the boss portion and on an outer peripheral side of the rib member.

The rib member may includes a plurality of ribs each having a ring-shape and arranged to be coaxial with the center axis of the boss portion, and the thickness reduced portion is formed between the ribs adjacent to each other.

The impeller may be preferably formed integrally with a synthetic resin.

The impeller is a centrifugal impeller preferably for a turbo-charger and is disposed on an intake side thereof.

According to the centrifugal impeller of the present invention of the characters mentioned above, since the thickness reduced portion is formed adjacent to the rib member, the total weight of the impeller can be reduced and, hence, the centrifugal force to be applied to the impeller when rotated can be reduced. In addition, even at a time when the impeller is rotated at a high speed, the destroy of the impeller can be suppressed.

Furthermore, the arrangement of the ring-shaped rib member can prevent the lowering in mechanical strength of the impeller because of the formation of the thickness reduced portion and ensure the strength or stiffness thereof against the centrifugal force even at the high speed rotation of the impeller.

Furthermore, since the rib member has a ring shape coaxial with the central axis of the boss portion, the rib member does not constitute a resistance when the impeller rotates around the rotational shaft inserted into the boss portion, thus reducing an aerodynamic load at the rotating time.

Still furthermore, since the impeller has a symmetrical peripheral shape around the boss portion, the flow of resin at an injection molding process can be well-balanced, and a mold can be easily formed.

The nature and further characteristic features will be made more clear from the following descriptions made with reference to the accompanying drawings.

DESCRIPTION OF THE PREFERRED EMBODIMENT

One preferred embodiment of the present invention will be described hereunder with reference to the accompanying drawings.

Figure 4:
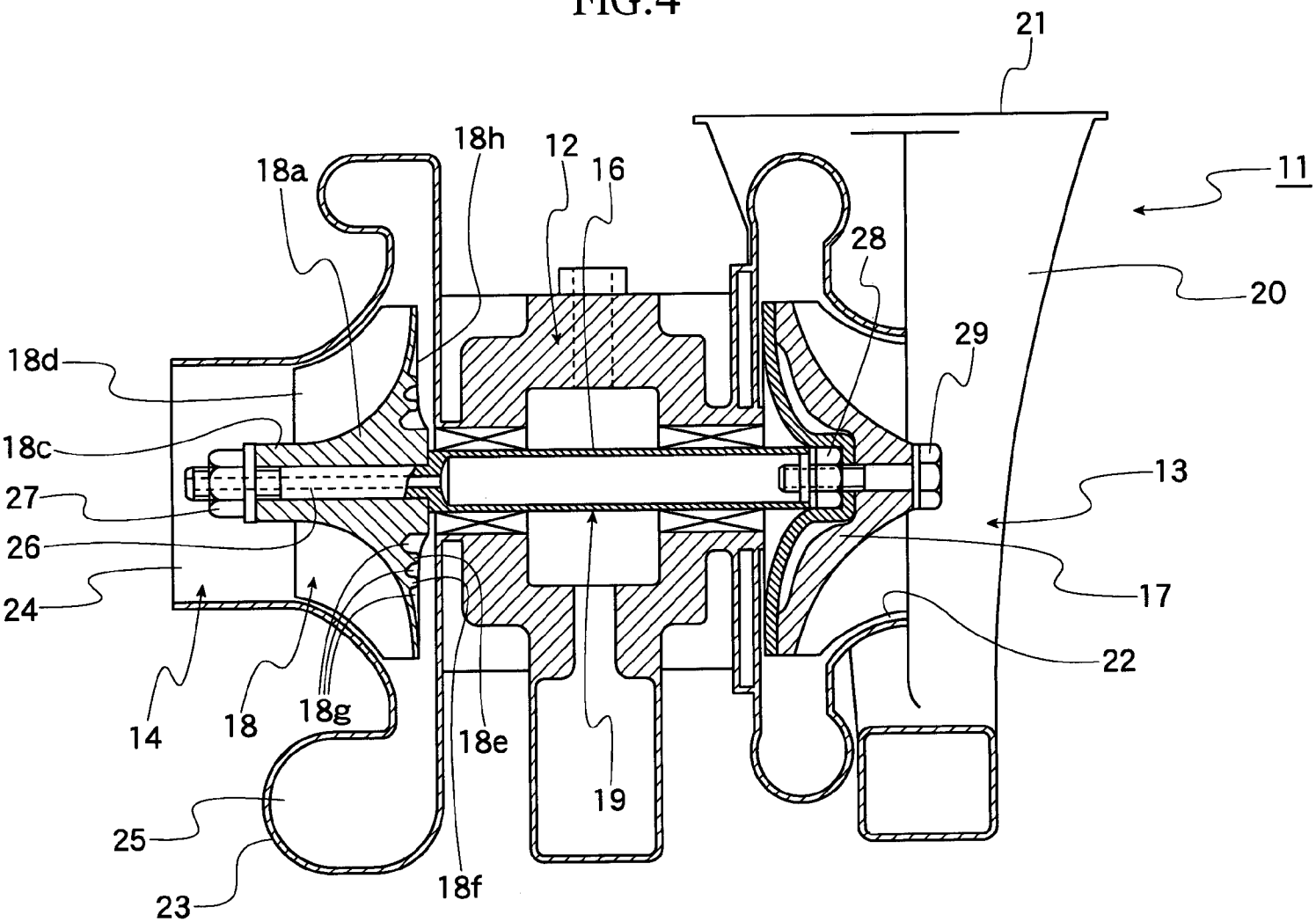
FIG. 4 is a sectional view of a turbo-charger to which the impeller of the present invention is applicable.

First, with reference to FIG. 4, showing a turbo-charger 11, the turbo-charger 11 has a bearing portion 12 at its central portion, a turbine section 13 on a right-side, as viewed, of the bearing portion 12 and a compressor section 14 on a left-side thereof.

A rotor 19 including a rotating shaft 16, a turbine wheel 17 and an impeller 18, as blade wheel, is supported to be rotatable by the bearing portion 12.

The rotating shaft 16 is provided, at its left end portion, with a small-sized (small diameter) impeller mount 26, to which the impeller 18 is fitted and fixed thereto by a nut 27. The rotating shaft 16 also has a right end portion to which a nut 28 is fixed. A nut 28 is firmly screwed by a bolt 29 to thereby fasten the turbine wheel 17.

In the turbine section 13, an engine exhaust gas fed from an inlet port 21 of a casing 20 and discharged from an outlet port 22 thereof gives a driving power to rotate the turbine wheel 17. According to this driving power, the impeller 18 of a compressor 14 is rotated to thereby suck an air through an inlet port 24 of the casing 20 and guide the compressed air to an intake tube of the engine through an intake passage 25.

The turbine-wheel 17 and the impeller 18 are rotated at a high speed of about more than 100,000 rpm.

Further, in the illustration of FIG. 4, although the casings 20 and 23 are formed as an integral structure for the sake of convenience, these casings are, in actual, composed of a plurality of divided pieces or sections.

Figure 1:
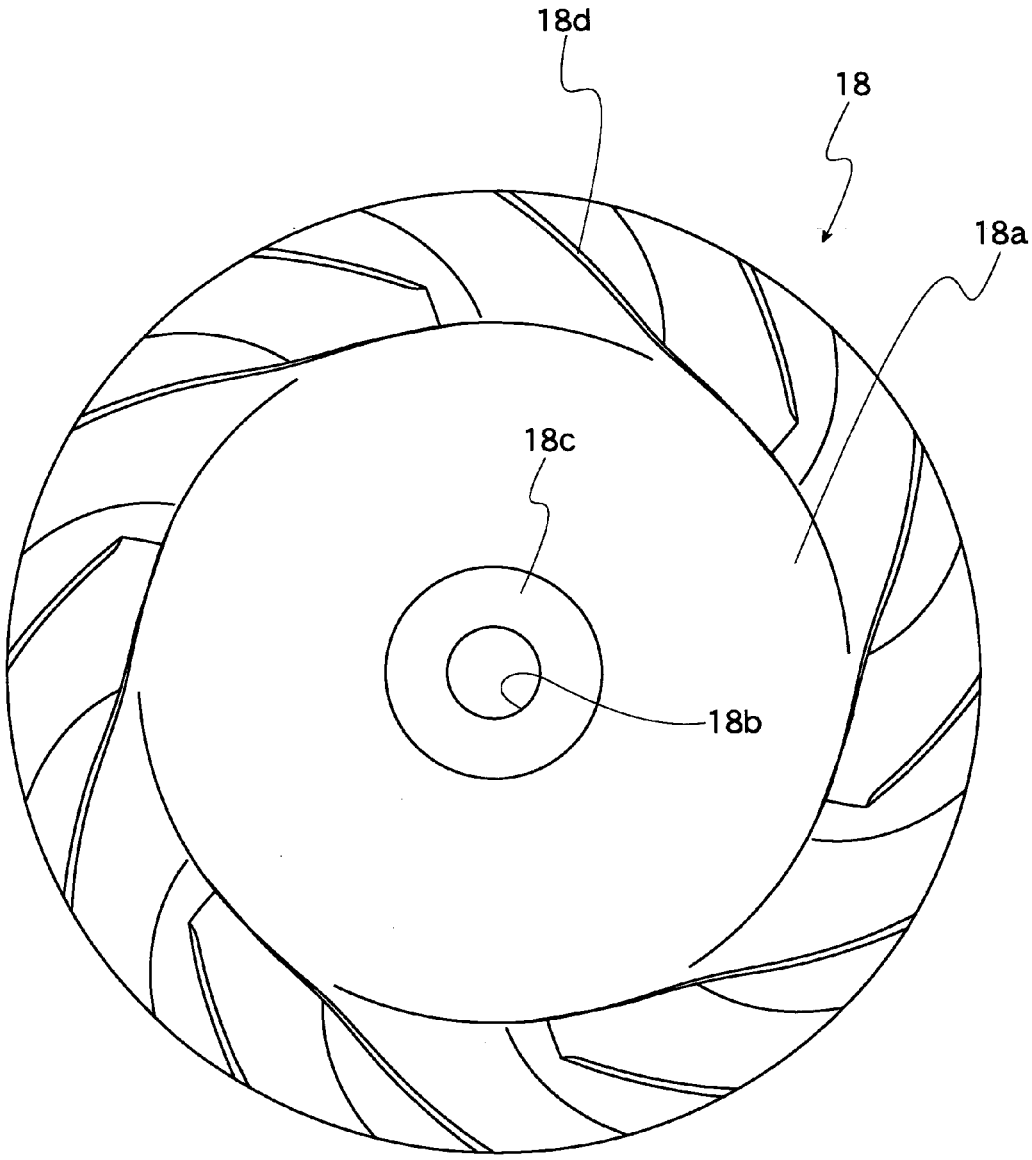
FIG. 1 is a plan view of an impeller according to one embodiment of the present invention.
Figure 2:
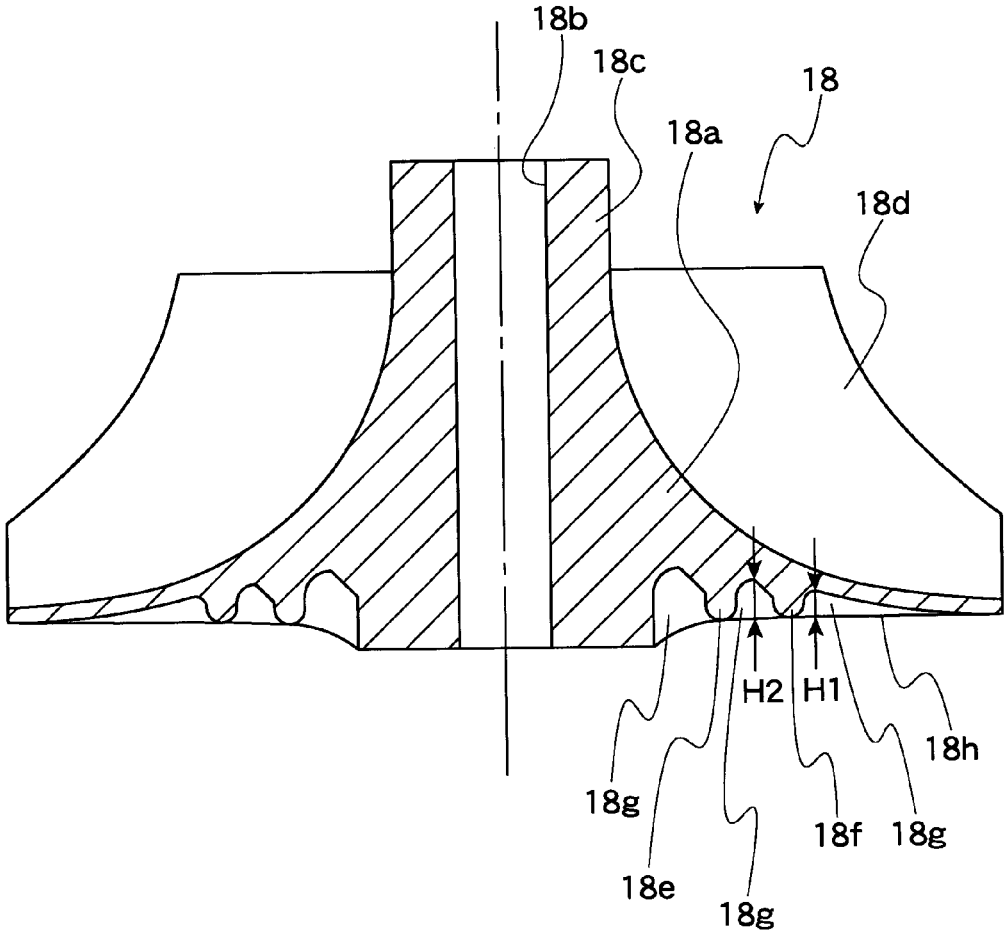
FIG. 2 is a sectional view of the impeller taken along the line passing the center of the impeller shown in FIG. 1.

The impeller 18 is, as shown in FIG. 2, provided with a circular disc portion 18*a*. This disc portion 18*a* is formed with a boss portion 18*c* having a central bore 18*b* through which the rotational shaft 16 is inserted, and an impeller blade (or impeller blade wheel) 18*d* is integrally formed to an upper side surface, as viewed, of the disc portion 18*a*. On the other hand, a plurality of ribs 18*e*, 18*f* (only two ribs are shown in FIG. 2), each in form of ring, are formed around the rotational shaft 16 at portions near the boss portion 18*c* on the lower side surface, as viewed, of the disc portion 18*a*.

Furthermore, a plurality of thickness reduced portions 18*g* are also formed between the boss portion 18*c* and the inner side rib 18*e*, between the respective ribs 18*e* and 18*f* and on the outer peripheral side of the rib 18*f*. The thickness reduced portion 18*g* is a portion of the disc portion having a thickness smaller than that of another portion of the disc portion. These ribs 18*e* and 18*f* have their top ends in substantially same level as a level of a bottom surface 18*h* of the disc portion 18*a*, and the height H2 of the rib 18*e* adjacent to the boss portion 18*c* is higher than the height H1 of the other rib 18*f*.

The formation of the thickness reduced portion makes it possible to reduce the weight of the impeller 18, which contributes to reduction of centrifugal force during the rotation, and hence, destroy or breakage thereof can be also suppressed.

Figure 3:
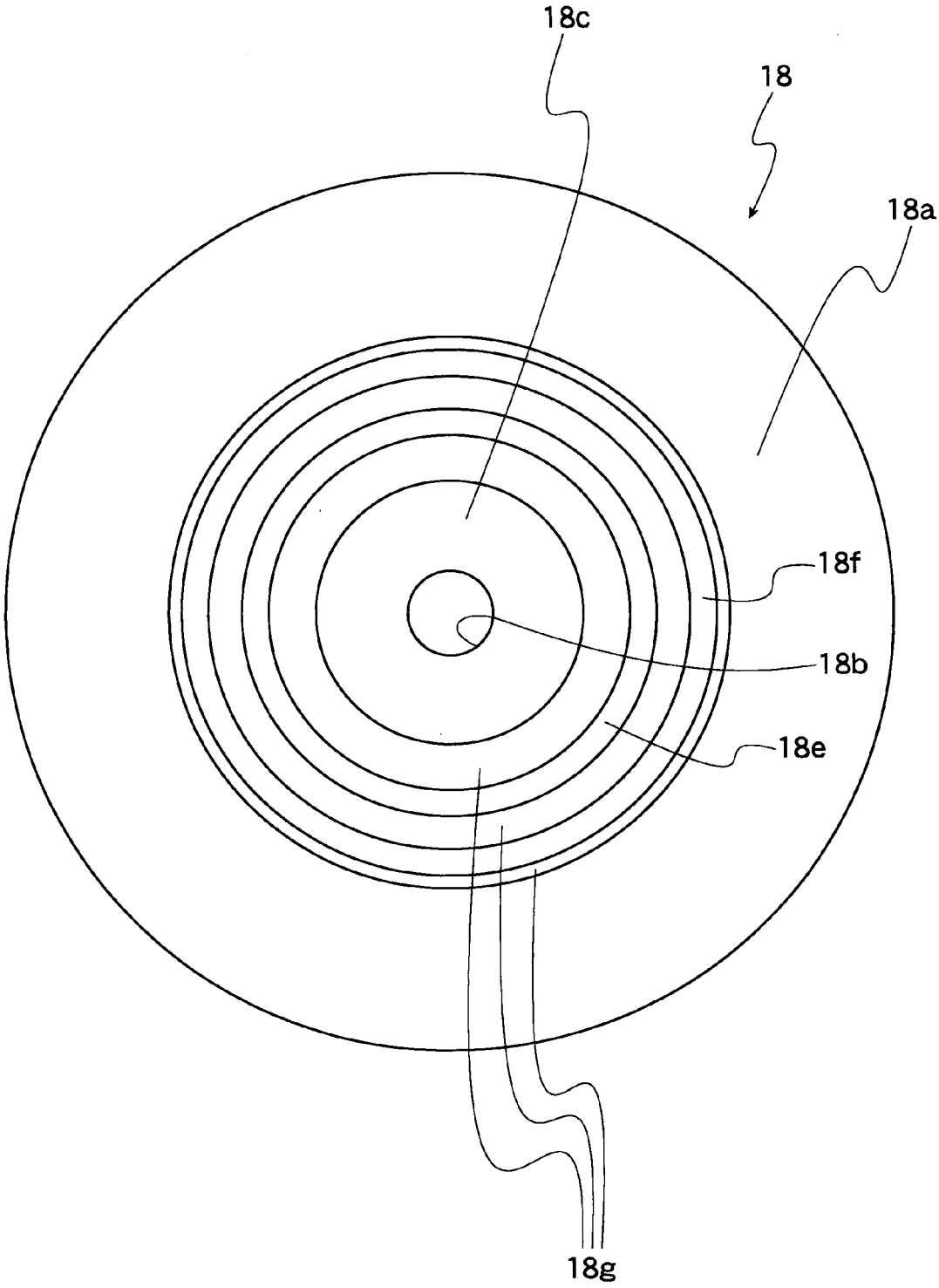
FIG. 3 is a view of the impeller viewed from a bottom side thereof.

Furthermore, as shown in FIG. 3, since the rib 18*e* (18*f*) is formed in shape of ring, the reduction in strength due to the formation of the thickness reduced portion 18*g* can be effectively prevented to thereby maintain the strength against the centrifugal force during the high-speed rotation of the impeller 18. In detail, at the time of the high-speed rotation of the impeller 18, the centrifugal force is applied to every portion of the impeller 18 and a load is applied to the impeller as if it widens the entire diameter of the disc portion 18*a*, but the location of the ring-shaped ribs 18*e* and 18*f* arranged continuously can effectively suppress the deformation due to such load without widening the diameter of the disc portion 18*a*, thus effectively preventing the impeller from being deformed and broken.

Still furthermore, since the ribs 18*e* and 18*f* have the ring shape around the central axis of the boss portion 18*c*, the ribs do not constitute resisting portions even at the time when the impeller 18 is rotated at a high speed around the central axis of the boss portion 18*c*, and hence, an aerodynamic load at the time of rotation can be effectively reduced from being applied.

In addition, the ribs 18*e* and 18*f* have the ring shape around the central axis of the boss portion 18*c* and, hence, the peripheral portion of the impeller 18 has the same shape around the central axis of the boss portion 18*c*, i.e., symmetrical therearound. Accordingly, the flow of resin at the injection molding process can be well balanced, and the formation of the mold can be also easily done.

It is to be noted that the present invention is not limited to the described embodiment and many other changes and modifications may be made without departing from the scopes of the appended claims.

For example, in the described embodiment, although the impeller 18 of the present invention is applied to the turbo-charger 11, the impeller 18 may be applied to other devices or apparatus which rotate at a high speed.

Furthermore, in the described embodiment, although the present invention is applied to the impeller made of synthetic resin, it may be applied to the impeller made of metal. In addition, the present invention is also applicable to a turbine-wheel disposed on an exhaust side of the turbo-charger.

Furthermore, in the described embodiment, although two ribs 18*e* and 18*f* are arranged, the present invention is not limited to such embodiment and one or more than two ribs may be arranged.

What is claimed is:

1. An impeller comprising:

a circular disc member;

a boss portion formed at a central portion of the disc member, said boss portion having a central through hole into which a rotational shaft is inserted;

an impeller blade integrally formed on one surface side of the disc member;

a rib member having a ring-shape and arranged on another surface side of the disc member so as to be coaxial with a center axis of the boss portion; and a thickness reduced portion formed to the disc member, said thickness reduced portion being arranged adjacent to the rib member, wherein said boss portion and said circular disc member form a lower portion on a bottom surface of said circular disc member, adjacent to said thickness reduced portion, the rib member having a top end at substantially the same level as the bottom surface of said disc member.

2. The impeller according to claim 1, wherein said thickness reduced portion is formed on at least one of the portions between the rib member and the boss portion and on an outer peripheral side of the rib member.

3. The impeller according to claim 1, wherein said rib member includes a plurality of ribs each having a ring-shape and arranged to be coaxial with the center axis of the boss portion.

4. The impeller according to claim 3, wherein said thickness reduced portion is formed to a portion between the ribs adjacent to each other.

5. The impeller according to claim 1, wherein the impeller is formed integrally with a synthetic resin.

6. The impeller according to claim 1, wherein the impeller is a centrifugal impeller for a turbo-charger and disposed on an intake side thereof.

7. The impeller according to claim 1, further comprising a second rib member, wherein the second rib member includes a second top end, said first top end and said second top end are at a substantially same level as the bottom surface of said disc member.

8. The impeller according to claim 1, further comprising a second rib member, wherein the height of the rib member is greater than the height of the second rib member.

9. The impeller according to claim 1, wherein the impeller is formed of a metal.

10. An impeller comprising:

a circular disc member;

a boss portion formed with said disc member, said boss portion having a central bore through which a rotational shaft is inserted;

an impeller blade integrally formed on one surface side of the disc member;

a rib member having a symmetrical shape around a center axis and arranged on another surface side of the disc member; and a thickness reduced portion formed in the disc member arranged adjacent to the rib member, wherein said boss portion and said circular disc member form a lower portion on a bottom surface of said circular disc member, adjacent to said thickness reduced portion, and the rib member having a top end at substantially the same level as the bottom surface of said disc member.

* * * * *